United States Patent [19]

Roccaforte

[11] 4,126,220

[45] Nov. 21, 1978

[54] DISPLAY CARTON AND BLANK THEREFOR

[75] Inventor: Harry I. Roccaforte, Western Springs, Ill.

[73] Assignee: Champion International Corporation, Stamford, Conn.

[21] Appl. No.: 857,099

[22] Filed: Dec. 5, 1977

[51] Int. Cl.[2] ..... B65D 5/50

[52] U.S. Cl. ..... 206/45.14

[58] Field of Search ..... 286/45.12, 45.14, 45.26, 286/45.31

[56] References Cited

U.S. PATENT DOCUMENTS

| | | | |
|---|---|---|---|
| 3,330,465 | 7/1967 | Davidson et al. | 206/45.14 X |
| 3,344,911 | 10/1967 | Wolowicz et al. | 206/45.14 |
| 3,687,279 | 8/1972 | Stone | 206/45.14 |
| 3,741,380 | 6/1973 | Carney | 206/45.14 |
| 3,746,156 | 7/1973 | Austin, Jr. | 206/45.14 |
| 3,750,870 | 8/1973 | Cote | 206/45.14 |
| 3,770,116 | 11/1973 | Cote | 206/45.14 |
| 3,819,035 | 6/1974 | Jaeschke | 206/45.14 |
| 3,901,382 | 8/1975 | Roccaforte | 206/45.14 |
| 4,037,717 | 7/1977 | Roccaforte | 206/45.14 |

*Primary Examiner*—Davis T. Moorhead

*Attorney, Agent, or Firm*—Evelyn M. Sommer

[57] ABSTRACT

A display carton for an elongated bottle which is equal in length to the display carton, but which bottle is of smaller width than the width of the carton is characterized by top and bottom support structures located within the carton for engaging the opposite ends of the elongated bottle for preventing its lateral shifting within the carton. Each support structure includes a first flap hingedly connected to the back panel and lying within and adjacent to the closure flap of the carton, and a second flap hingedly connected to the first flap and oriented at an angle with respect to the inside plane of the front panel. The second flap is of greater length than the first flap and has a central opening corresponding in configuration to the respective end of the bottle, and thereby serves to restrain the bottle from lateral movement within the carton.

5 Claims, 10 Drawing Figures

DISPLAY CARTON AND BLANK THEREFOR

The subject invention relates to a new and improved display carton and a blank for making same, and more particularly, a display carton which is adapted to accommodate an elongated bottle where the length of the bottle corresponds to the length of the display carton, but where the width of the display carton is greater than the width of the bottle. In order to prevent the bottle from laterally shifting within the display carton, means are provided for restraining the bottle from moving sideways, and such means are constructed such that the carton may be totally automatically packaged utilizing conventional packaging equipment. In the subject invention, the means for restraining the elongated bottle from moving sideways in the display carton are unitary with the end flaps, and are foldable into a support structure to support and restrain the ends of the elongated bottle.

Heretofore, most display cartons for small objects, such as pharmaceuticals or cosmetics, are of the shadow panel variety and are hand loaded and closed. There is a need for a carton style which will restrain and protect a glass bottle to reduce damage during shipment and storage, while at the same time be attractive on the retailer's shelf. There is also need for such a carton which can be automatically erected, loaded and closed on currently available cartoning equipment.

U.S. Pat. No. 4,037,717 which issued to the applicant, Harry I. Roccaforte, on July 26, 1977, and entitled "Display Carton" is assigned to the assignee of the subject application and provides a new and improved display carton wherein the opposite ends of the carton include "cushioning structures" for supporting and restraining an article such as a glass bottle within a display carton. In such case, the cushioning structure of the display carton of U.S. Pat. No. 4,037,717 requires that the length of the bottle be less than the total length of the display carton. The subject invention is directed to a new and improved display carton wherein the length of the bottle containing the pharmaceutical or cosmetic is substantially equal to the length of the carton, and wherein at least one end of the bottle is of less width than the width of the carton. Accordingly, it is required to provide means for preventing and restraining the bottle from moving sideways, and at the same time, insuring that such means may be erected by automatic packaging equipment and that the bottle object may be automatically loaded into such carton. This objective is achieved by the subject invention, and in one embodiment, wherein lateral restraining means are required at both opposite ends of the carton, two panel restraining means are erected over the top and bottom of the bottle, each forming a bulge which encases the bottle and prevents sideward movements. The bulge or triangularly shaped support structure at each end of the carton is accomplished by off-setting the end panels so that the total of the panels provides the necessary bulge, and each panel includes cuts that are essential in automatic loading equipment in order to prevent the leading part of the bottle from hitting the thickness of the paperboard from which the display carton is made, which, of course, would result in jamming of the machine. The subject support structure provided at each end of the display carton functions to lead or funnel the object into the carton with ease.

More particularly, the subject invention is a display carton and a blank for making same wherein, as required, the carton includes a unitary top support structure and/or a bottom support structure, which support structure includes a first flap hingedly connected to the back panel and lying on the inside of the top closure flap of the carton. A second flap is hingedly connected to said first flap and oriented at an angle with respect to the inside plane of the front panel, and the second flap is of greater length than the first flap. Accordingly, when the support structure is erected, the second flap effectively "bulges out", and since it includes a central opening corresponding to the configuration of cap end of the bottle, the second flap serves to restrain the cap of the bottle from lateral movement within the carton. A glue flap is hingedly connected to the second flap and is arranged vertically on and secured to the inside of the back panel, thereby maintaining the bulge support structure in its erected condition for continued restraint of the bottle from lateral movement.

Further objects and advantages of the subject invention will become apparent from a following detailed description taken in conjunction with the drawings in which.

Figure 1:
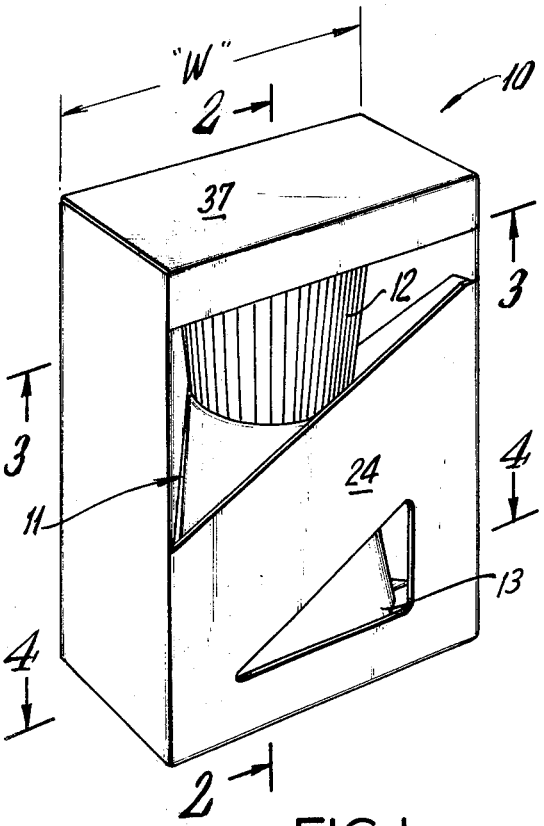
FIG. 1 is a perspective view of an assembled display carton containing an article which embodies the present invention.
Figure 2:
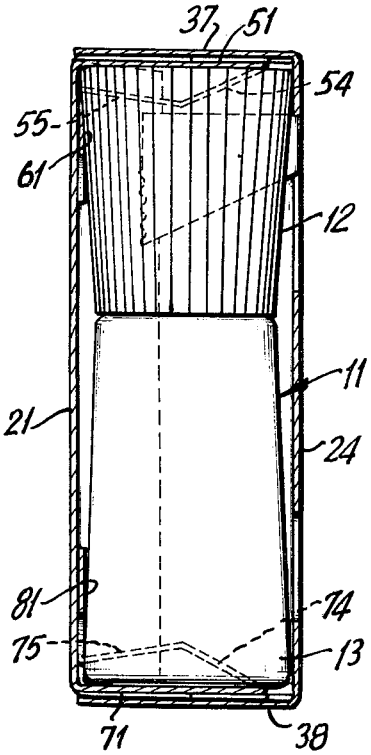
FIG. 2 is a side elevational view of the subject display carton and bottle of FIG. 1 taken along line 2—2 in FIG. 1.
Figure 3:
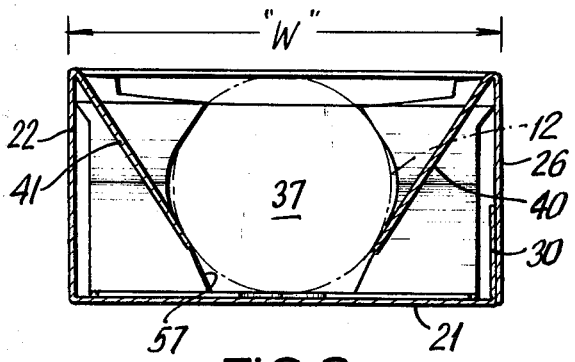
FIG. 3 is a cross-sectional view taken along line 3—3 in FIG. 1.
Figure 4:
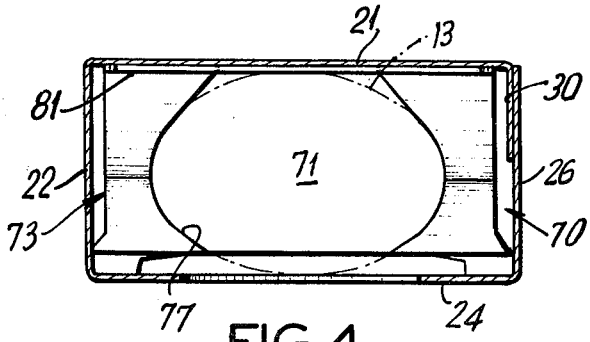
FIG. 4 is a cross-sectional view taken along line 4—4 in FIG. 1.

Referring to FIGS. 1–4, the display carton of the subject invention is designated by the numeral 10 and is intended for use in the shipping and display of pharmaceutical or cosmetic type containers, such as bottle 11, which must be attractively packaged and yet protected during shipment and storage. Bottle 11 includes an upper cap portion 12 which is of generally oval configuration, and a base portion 13 which is also of generally oval configuration. The width of the display carton 10 is designated by the letter "W", and is of greater width than the cap 12 and the base portion 13. On the other hand, the total length of bottle 11, as seen in FIG. 2, substantially corresponds to the total length or height of the carton 10.

Figure 5:
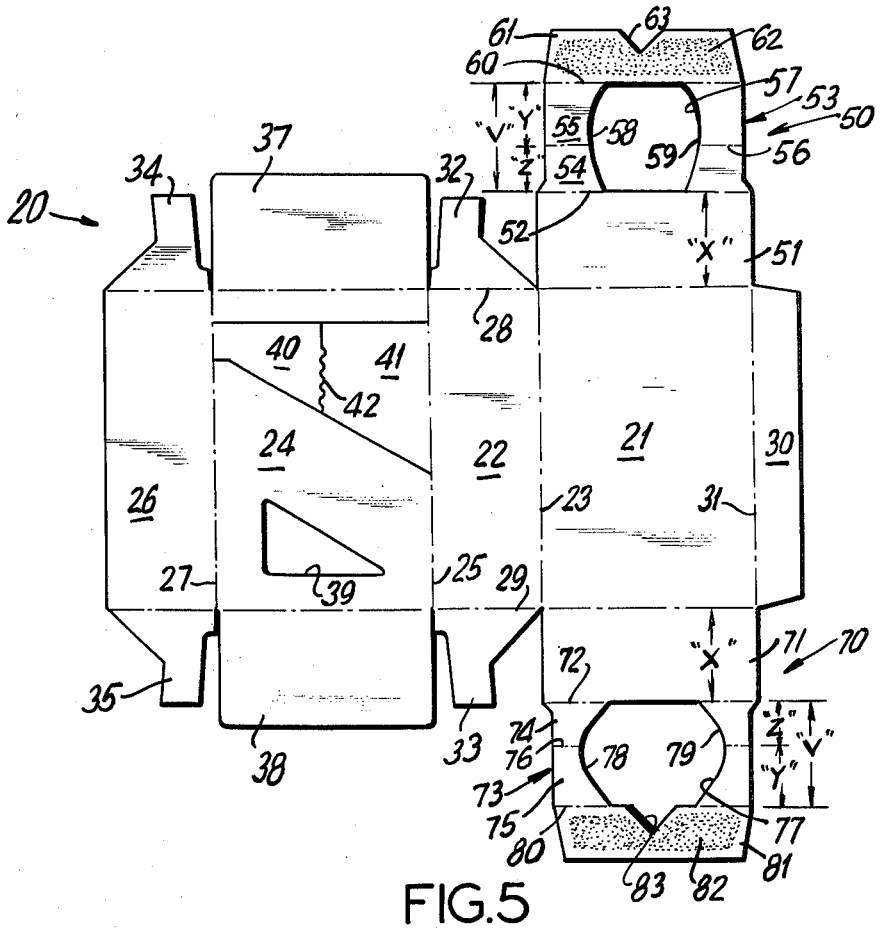
FIG. 5 is a plan view of a blank adapted to be erected into the display carton such as shown in FIGS. 1 through 4.

Display carton 10 is erected from a foldable blank 20 (see FIG. 5) that is preferably made of a foldable paperboard or similar sheet-like material. Blank 20 includes a back panel 21 which is generally rectangular in shape, and is hingedly connected along fold line 23 to a first side panel 22. In turn, first side panel 22 is hingedly connected along fold line 25 to front panel 24, with the second side panel being designated by the numeral 26 and hingedly connected to the front panel 24 along fold line 27. These four panels 21, 22, 24, and 26 are connected by the vertically extending hinge lines 23, 25, and 27 and are defined along their top and bottom edges by parallel fold lines 28 and 29. The four panels are foldable together into a generally rectangular tubular relationship that is held in place by a conventional manufacturer's joint. As shown in FIG. 5, the manufacturer's joint comprises a glue flap 30 which is hingedly connected to the back panel 21 along hinge line 31 and is adapted to be bonded to the inside of the second side panel 26. Side panels 22 and 26 have end closure flaps hingedly attached at the top and bottom edges thereof along the fold lines 28 and 29, and said end closure flaps are designated by the numerals 32, 33, 34, and 35, respectively. The front panel 24 has attached to the top and bottom thereof along fold lines 28 and 29, end closure flaps 37 and 38 which also form a part of the end closures of the finished carton. The front panel 24 includes an aperture 39, as well as opposed shadow panels 40 and 41 that are separated by a cut line 42.

In order to restrain the upper or cap portion 12 of the bottle 11 from lateral movement within the erected display carton 10, blank 20 includes a top support structure designated by the numeral 50. An analogous structure is located along the bottom edge of the back panel 21 along fold line 29, and is designated by the numeral 70 as means for supporting and preventing lateral shifting of the base portion 13 of bottle 11.

Upper support means 50 includes a first flap 51 which is rectangular in cross-section and is defined along its top edge by a fold line 52. The total height of the first flap is designated by the letter "X". Hingedly connected along fold line 52 is a second flap 53 including flap sections 54 and 55 which are hingedly connected along fold line 56 that is disposed parallel to fold line 52. The total height of flap section 54 is designated by the letter "Z", whereas the total height or length of the flap section 55 is designated by the letter "Y". The overall height or length of the second flap means 53 comprises the combination of "Z" and "Y", and is designated by the letter "V". The dimension "V" is greater than the dimension "X", whereas the length of the first flap 51 (i.e., "X") is greater than each individual section 54 and 55 ("Z" and "Y", respectively). Hingedly connected to the second flap means 53 along hinge line 60 is a glue flap 61 to which adhesive 62 has been applied, with the glue flap 61 including a V-shaped cut 63.

The second flap means 53 includes a central opening 57 that is formed by two cuts or slots 58 and 59 which extend between the hinge lines 52 and 60. Slots 58 and 59 result in the aperture 57 being of a configuration corresponding and complimentary to the configuration of the cap 12 of the bottle 11. As illustrated in the figures, slots 58 and 59 may be V-shaped such that the aperture 57 substantially corresponds to the oval configuration of the cap 12. Thus the cap is prevented from laterally shifting within the display carton 10.

Figure 9:
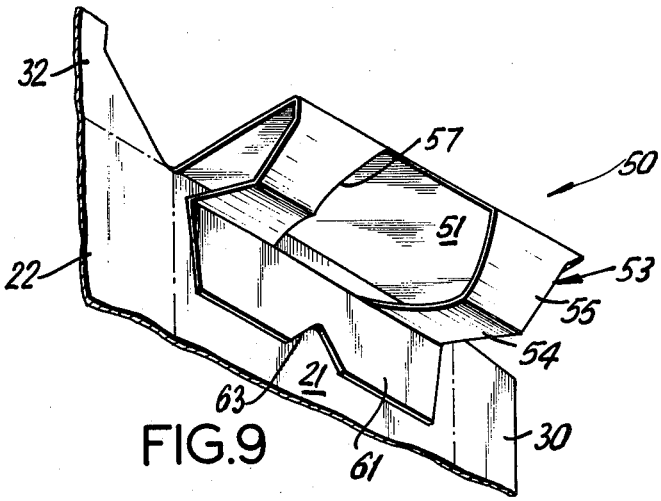
FIG. 9 is a perspective view of the upper support structure of the subject display carton illustrating the relationship of the various parts thereof.

The relative position of the elements of the upper support means 50 may be seen best in FIG. 9 where it can be seen that the first flap 51 extends at a right angle to the back panel 21, and thus is disposed immediately below the upper closure end of the display carton (see FIG. 2). The total length "V" of the second flap means 53 is greater than the total length "X" of the first flap means 51, and by virtue of the glue flap 61 being bonded to the inside surface of the back panel 21, the second flap means 53 forms a bulge or bowed section which extends at an acute angle to the front panel 24 of the display carton (See also FIG. 2). In addition, the central opening 57 formed by the two slots 58 and 59 define a generally arcuate opening for the reception of the cap 12 of bottle 11. The entire structure of the upper support means 50 is maintained in place by the glue flap 61 that is disposed on the inner surface of the back panel 21. In the erected condition the upper support means 50 serves to prevent the cap 12 from sideways movement within the display carton, and at such time, the top portion of the cap 12 is substantially in abutting contact with the first flap 51.

Figure 10:
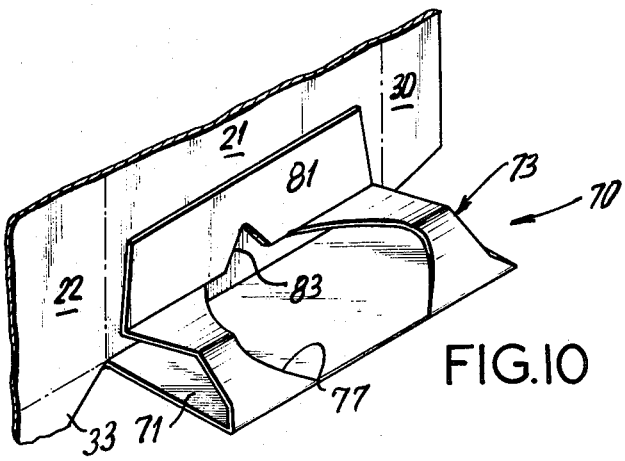
FIG. 10 is a perspective view of the bottom support structure with the remainder of the carton broken away.

The bottom support structure 70 is similar in arrangement to the upper support means 50, with the exception that the central aperture is shaped in a slightly different and larger size to accommodate the oval lower base portion 13 of the bottle 11. A first bottom flap 71 is hingedly connected to the bottom edge 29 of the back flap 21 and is of a length designated "X", and is hingedly connected along fold line 72 to a second bottom flap means 73. The latter includes a first bottom flap section 74 of a length "Z" and a second bottom section 75 of a length "Y". The relationship between the various lengths "X", "Y", and "Z" correspond to the relationship between the elements of the upper support means 50. Bottom flap sections 74 and 75 are hingedly connected along fold line 76, and a glue flap 81 is hingedly connected to the second flap means 73 along hinge line 80. Glue flap 81 includes adhesive 82 as well as a V-shaped cut 83. A central opening or aperture 77 is provided in the second bottom flap means and is formed by two slots or cuts 78 and 79. The bottom support means 70 is seen in FIG. 10 in its erected condition, and it is obvious that the base or bottom of the bottle 11 rests against the first bottom flap means 71, with the second bottom flap means 73 restraining the base portion 13 of the bottle from side movement, with said base portion 13 being accommodated within the curved aperture 77 of the bottom support means 70. The glue flap 81 is attached to the inner portion of the back panel 21, and the second bottom flap 73 is disposed at an angle with respect to the front panel 24 of the display carton, as shown in FIG. 2.

As previously indicated, the front panel 24 includes a lower restraining section which extends across the entire width of the panel 24 in order to prevent the bottle 11 from moving outward after it has been loaded and in position, and with said panel 24 including a viewing aperture 39 therein. The panel 24 may serve to hold graphics or other aesthetic features for the package. The shadow panels 40 and 41 are defined in the front panel 24 and are separated by a cut line 42 and function to provide the desired shadow box aesthetic features of the display carton 10.

Figure 6:
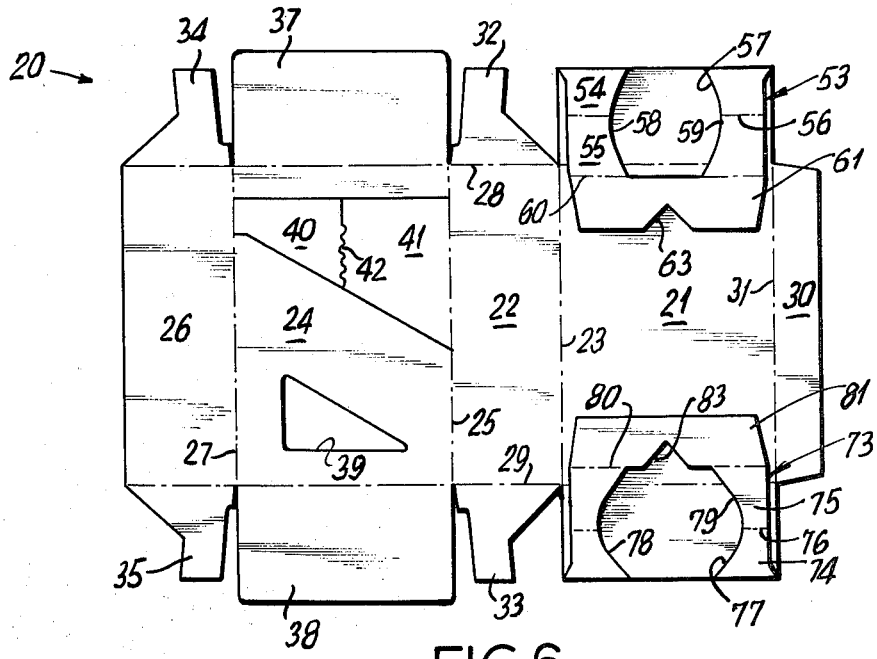
FIG. 6 is a plan view of the blank shown in FIG. 5 but partially folded and glued as would typically be performed on automatic equipment.
Figure 7:
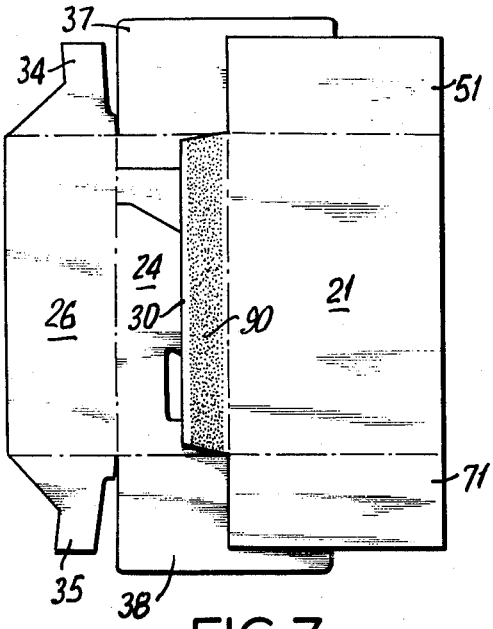
FIG. 7 is a plan view of the blank of FIG. 6 illustrating the next folding step.
Figure 8:
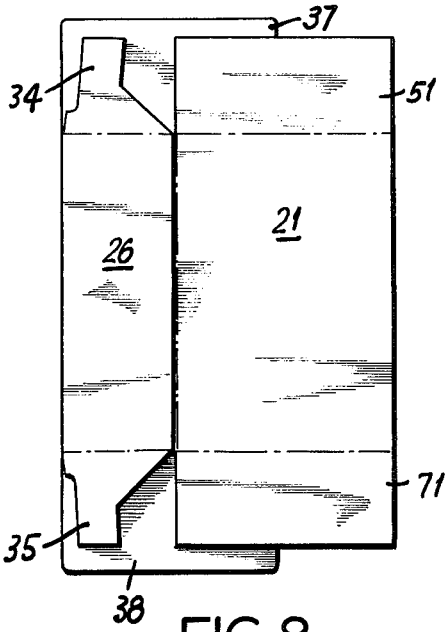
FIG. 8 illustrates the final folded and glued position of the blank prior to loading.

As previously mentioned, the display carton 10 may be erected, loaded and sealed on conventional automatic equipment. FIGS. 6 through 8 illustrate the folding which may be done on a right angle folder-gluer. The first step as shown in FIG. 5 is the application of adhesive 62 and 82 on the glue flaps 61 and 81, respectively. Next, the glue flaps are folded about the fold lines 60 and 80 and the adhesive patterns 62 and 82 are pressed into contact with the back panel 21. FIG. 7 then illustrates how the right hand portion of the carton 10 is folded over about the fold line 23 which is followed by the application of adhesive 90 on the manufacturer's glue flap 30 followed, in turn, by the folding of the side panel 26 on top of the manufacture's glue flap 30 to give the final configuration shown in FIG. 8. The carton may then be end loaded and sealed on conventional automatic equipment thereby reducing the amount of labor required to prepare the package for shipment.

Accordingly, there is provided a new and improved display carton, and a blank for forming same, which carton is adapted to accommodate a bottle containing pharmaceuticals or cosmetics which is equal in length to the total length or height of the display carton, yet one or both opposite ends of the bottle are of less width than the total width of the carton. The subject carton includes new and improved support means for restraining lateral movement of the bottle within the erected carton, and by virtue of the construction of the carton, the carton may be totally automatically erected and packaged. The apertures of the subject display carton which are designed to accommodate the opposite ends of the bottle are formed of slots or cuts which function to lead or funnel the bottle into the carton with ease, thereby obviating jamming or interference of the bottle with the carton during a loading operation.

As is apparent in those instances where one end of a bottle is of the same width "W" as the display carton, only one support means would be required.

The present invention has been described in the above specification with reference to a specific embodiment, and such reference has been made for purely illustrative purposes and various modifications in the details included therein may be made without departing from the scope or spirit of the invention, as will be obvious to those skilled in this art.

What is claimed is:

1. A display carton for an elongated bottle having at one end a cap, while the other end thereof is a closed base portion, said carton having front, back, and side panels arranged in a general rectangular tubular configuration with end flaps closing the top and bottom ends thereof; and with the width of the carton being greater than the width of said cap and the base portion of the bottle, while the length of said carton substantially corresponds to the length of said elongated bottle, said carton comprising:

a top support structure located at the top of said carton and inside the top closure flaps, said top support structure including a first flap hingedly connected to said back panel along the top edge thereof and lying on the inside of the top of the carton, a second flap hingedly connected to said first flap and oriented at an angle with respect to the inside plane of the front panel, said second flap being of greater length than said first flap and having a first central opening corresponding to the configuration of the cap of the elongated bottle, said second flap including two sections hingedly connected along a fold line extending parallel to the top edge of the carton, with the section contiguous to said glue flap being of greater length than the other section, and with said first central opening being defined by two V-shaped slots, said second flap serving to restrain said elongated bottle cap from lateral movement within said carton; and a first glue flap hingedly connected to said second flap and arranged vertically on and adhesively bonded to the inside of said back panel; and a bottom support structure located at the bottom of said carton and inside said bottom closure flaps, said bottom support structure including a first bottom flap hingedly connected to said bottom panel along the bottom edge thereof and lying on the inside of the bottom of the carton, a second bottom flap hingedly connected to said first bottom flap and oriented at an angle with respect to the inside plane of the front panel, said second bottom flap being of greater length than said first bottom flap and having a second central opening corresponding to the configuration of the base portion of the elongated bottle, said second bottom flap including two sections hingedly connected along a fold line extending parallel to the bottom edge of the carton, with the section of said second bottom flap contiguous to said bottom glue flap being of greater length than the other section of the second bottom flap and with the second central opening being defined by two V-shaped slots, said second bottom flap serving to restrain said base portion from lateral movement within said carton; and a bottom glue flap hingedly connected to said second bottom flap and arranged vertically on and adhesively bonded to the inside of said back panel.

2. A display carton as in claim 1 wherein said front panel includes openings for partial viewing of the elongated bottle.

3. A blank made of paperboard and adapted to be folded into a display carton of generally rectangular and tubular shape for accommodating an elongated bottle having at one end a cap, while the other end is a closed base portion with the width of the erected display carton being greater than the width of the cap, and wherein the width of the erected carton is also greater than the width of the base portion of said elongated bottle, comprising:

a substantially rectangular sheet of said paperboard, said sheet having opposed vertical lateral edges and opposed horizontal top and bottom edges, the length of the blank between said top and bottom edges thereof corresponding to the length of the bottle;

four vertically spaced parallel hinge lines intermediate the lateral edges thereof defining a pair of side walls, a front panel, a back panel, and a manufacturer's glue flap positioned at one lateral edge thereof;

said side walls and side front panel having end closure flaps hingedly attached to the top and bottom edges thereof along said top and bottom horizontal edges;

said back panel having a first rectangular flap hingedly attached along the top edge thereof;

said first flap having a top support structure hingedly attached thereto along a horizontal fold line;

said top structure including a second flap hingedly connected along a horizontal fold line to said first flap, with the length of said second flap being greater than the length of the first flap, said second flap including a central aperture corresponding in configuration, but of greater size than the configuration of the cap of the elongated bottle;

a first glue flap hingedly connected to said second flap along a horizontal fold line;

a third flap hingedly attached along the bottom edge of said back panel;

said third flap having a bottom support structure hingedly attached thereto along a horizontal fold line;

said bottom support structure including a fourth flap hingedly connected along a horizontal fold line to said third flap, with the length of said fourth flap being greater than the length of said third flap, said fourth flap including a central aperture corresponding in configuration, but of greater size, than the base portion of said elongated bottle; and a second glue flap connected to said fourth flap along a horizontal fold line.

4. A blank as in claim 3 wherein said front panel includes aperture means for partially displaying the contents of the carton.

5. A blank as in claim 3 wherein each central aperture in the second flap and the fourth flap includes a V-shaped cut-out portion.

* * * * *